US009897110B2

(12) United States Patent
Tamaki

(10) Patent No.: US 9,897,110 B2
(45) Date of Patent: Feb. 20, 2018

(54) CENTRIFUGAL COMPRESSOR

(71) Applicant: IHI Corporation, Tokyo (JP)

(72) Inventor: Hideaki Tamaki, Tokyo (JP)

(73) Assignee: IHI CORPORATION (JP)

( * ) Notice: Subject to any disclaimer, the term of this patent is extended or adjusted under 35 U.S.C. 154(b) by 518 days.

(21) Appl. No.: 14/372,083

(22) PCT Filed: Jan. 23, 2013

(86) PCT No.: PCT/JP2013/051318
§ 371 (c)(1),
(2) Date: Jul. 14, 2014

(87) PCT Pub. No.: WO2013/111780
PCT Pub. Date: Aug. 1, 2013

(65) Prior Publication Data

US 2014/0377053 A1 Dec. 25, 2014

(30) Foreign Application Priority Data

Jan. 23, 2012 (JP) ..... 2012-010789

(51) Int. Cl.
*F04D 29/68* (2006.01)
*F04D 29/42* (2006.01)
(Continued)

(52) U.S. Cl.
CPC ..... *F04D 29/685* (2013.01); *F04D 29/4213* (2013.01); *F04D 29/4226* (2013.01);
(Continued)

(58) Field of Classification Search
CPC .... F04D 29/685; F04D 29/681; F04D 29/665; F04D 27/023; F05D 2200/261; F05D 2200/262; F05D 2200/26
See application file for complete search history.

(56) References Cited

U.S. PATENT DOCUMENTS 4,990,053 A 2/1991 Rohne
5,246,335 A * 9/1993 Mitsubori ..... F04D 29/4213 415/214.1
(Continued)

FOREIGN PATENT DOCUMENTS

CN 1039087 A 1/1990
CN 1059959 A 4/1992
(Continued)

OTHER PUBLICATIONS

Office Action dated Oct. 8, 2015 in correspondin Chinese Patent Application No. 201380005770.9 with English language translation of a part of the Search Report (8 pages).
(Continued)

*Primary Examiner* — Richard Edgar
*Assistant Examiner* — Michael Sehn
(74) *Attorney, Agent, or Firm* — Ostrolenk Faber LLP

(57) ABSTRACT

The centrifugal compressor (1) includes: an impeller (3); and a casing (2) accommodating the impeller (3). The casing (2) includes: an inlet (6); an impeller-accommodating portion (14) in which the impeller (3) is disposed; an annular flow passageway (5) formed around the impeller (3); an outlet (9) communicating with the annular flow passageway (5); and an annular chamber (11) formed around at least one of the inlet (6) and the impeller-accommodating portion (14). An inner circumferential surface (2*a*) of the casing (2) facing the impeller-accommodating portion (14) is provided with a groove (12) which communicates the impeller-accommodating portion (14) and the annular chamber (11) with each other and which is formed over the entire circumference of the inner circumferential surface (2*a*). In addition, the annular chamber (11) communicates with another space only through the groove (12).

3 Claims, 5 Drawing Sheets

(51) Int. Cl.
*F04D 29/66* (2006.01)
*F04D 29/44* (2006.01)

(52) U.S. Cl.
CPC ..... *F04D 29/441* (2013.01); *F04D 29/665* (2013.01); *F04D 29/681* (2013.01)

(56) References Cited

U.S. PATENT DOCUMENTS

| | | | | |
|---|---|---|---|---|
| 2010/0014956 | A1 | 1/2010 | Guemmer | 415/9 |
| 2011/0091323 | A1* | 4/2011 | Koike | F04D 29/284 416/175 |
| 2012/0321440 | A1* | 12/2012 | Zheng | F04D 29/4213 415/58.4 |

FOREIGN PATENT DOCUMENTS

| | | | |
|---|---|---|---|
| CN | 1116280 | A | 2/1996 |
| EP | 0526965 | A2 | 2/1993 |
| JP | 04-017198 | | 2/1992 |
| JP | 07-279677 | | 10/1995 |
| JP | 2004-332734 | | 11/2004 |
| JP | 2009-209694 | | 9/2009 |
| JP | 2012-154200 | | 8/2012 |
| WO | WO 94/02742 | | 2/1994 |
| WO | WO 2011/099418 | A1 | 8/2011 |

OTHER PUBLICATIONS

International Search Report and Written Opinion dated Apr. 23, 2013 in corresponding PCT International Application No. PCT/JP2013/051318.

European Search Report, dated Aug. 5, 2015, issued in corresponding European Patent Application No. EP13741154.2. Total 6 pages.

* cited by examiner

CENTRIFUGAL COMPRESSOR

CROSS-REFERENCE TO RELATED APPLICATIONS

The present application is a 35 U.S.C. § § 371 national phase conversion of PCT/JP2013/051318, filed Jan. 23, 2013, which claims priority to Japanese Patent Application No. 2012-010789, filed Jan. 23, 2012, the contents of which are incorporated herein by reference. The PCT International Application was published in the Japanese language.

TECHNICAL FIELD

The present invention relates to a centrifugal compressor which increases the pressure of a compressible fluid.

BACKGROUND ART

In order to increase the pressure of a compressible fluid, for example, a centrifugal compressor is used. The operation range of a centrifugal compressor may be limited, because surging occurs due to a reverse flow or the like of a fluid while the flow rate thereof is low (when the flow rate of the fluid is decreased in order to increase the pressure of the fluid). When the surging occurs, the operation of the centrifugal compressor becomes unstable. Accordingly, if the surging is suppressed, the operation range of the centrifugal compressor can be extended.

As one means of suppressing surging, casing treatment disclosed in Patent Document 1 is used.

A centrifugal compressor includes an impeller rotating at a high speed, and a casing which accommodates the impeller and in which a scroll passageway is formed around the impeller. In the casing treatment disclosed in Patent Document 1, the wall surface of the casing adjacent to the upstream end of the impeller is provided with a groove formed over the entire circumference of the wall surface, and the groove is communicated with a flow passageway positioned upstream of the impeller. While the flow rate of a fluid is low, a fluid reversely flows upstream of the impeller through the groove from a high-pressure part which locally occurs in an impeller-accommodating portion of the casing, and by recirculating part of fluid, the fluid is prevented from reversely flowing in the impeller-accommodating portion, thereby suppressing the surging.

Using the casing treatment as described above, the effect of suppressing surging is obtained. However, extension of the operation range of a centrifugal compressor by further reducing surging is desired.

DOCUMENT OF RELATED ART

Patent Document

[Patent Document 1] Japanese Patent Application, First Publication No. 2004-332734

SUMMARY OF INVENTION

Technical Problem

The present invention was made in view of the above circumferences, and an object thereof is to provide a centrifugal compressor capable of improving the effect of suppressing surging and capable of extending the operation range thereof by performing more efficient casing treatment.

Solution to Problem

According to a first aspect of the present invention, a centrifugal compressor includes: an impeller; and a casing accommodating the impeller. The casing includes: an inlet; an impeller-accommodating portion in which the impeller is disposed; an annular flow passageway formed around the impeller; an outlet communicating with the annular flow passageway; and an annular chamber formed around at least one of the inlet and the impeller-accommodating portion. An inner circumferential surface of the casing facing the impeller-accommodating portion is provided with a groove which communicates the impeller-accommodating portion and the annular chamber with each other and which is formed over the entire circumference of the inner circumferential surface. In addition, the annular chamber communicates with another space only through the groove.

According to a second aspect of the present invention, in the first aspect, the groove is formed as a curved line which cyclically changes so that the entire circumference of the inner circumferential surface is one cycle and which has a predetermined amplitude in a central axis direction of the inlet. In addition, a most upstream point of the groove is provided at a position facing an upstream end of a vane of the impeller in the central axis direction.

According to a third aspect of the present invention, in the second aspect, the casing includes a tongue portion formed between the outlet and the annular flow passageway. In addition, a most downstream point of the groove is positioned in a range from a position of 120° upstream with respect to a reference radial line connecting a rotation center of the impeller and the tongue portion, to a position of 60° downstream with respect to the reference radial line.

According to a fourth aspect of the present invention, in the third aspect, the most downstream point of the groove is positioned in a range from a position of 45° upstream with respect to the reference radial line, to a position of 45° downstream with respect to the reference radial line.

Effects of Invention

According to the present invention, a centrifugal compressor includes: an impeller; and a casing accommodating the impeller. The casing includes: an inlet; an impeller-accommodating portion in which the impeller is disposed; an annular flow passageway formed around the impeller; an outlet communicating with the annular flow passageway; and an annular chamber formed around at least one of the inlet and the impeller-accommodating portion. An inner circumferential surface of the casing facing the impeller-accommodating portion is provided with a groove which communicates the impeller-accommodating portion and the annular chamber with each other and which is formed over the entire circumference of the inner circumferential surface. In addition, the annular chamber communicates with another space only through the groove. Therefore, even when the pressure of part of the impeller-accommodating portion increases, the increased pressure is dispersed into the annular chamber through the groove. Consequently, excellent effects that the effect of suppressing surging can be improved and that the operation range of a centrifugal compressor can be further extended are obtained.

DESCRIPTION OF EMBODIMENTS

Hereinafter, embodiments of the present invention are described with reference to the drawings.

First, the outline of a centrifugal compressor according to an embodiment of the present invention is described with reference to FIG. 1.

Figure 1:
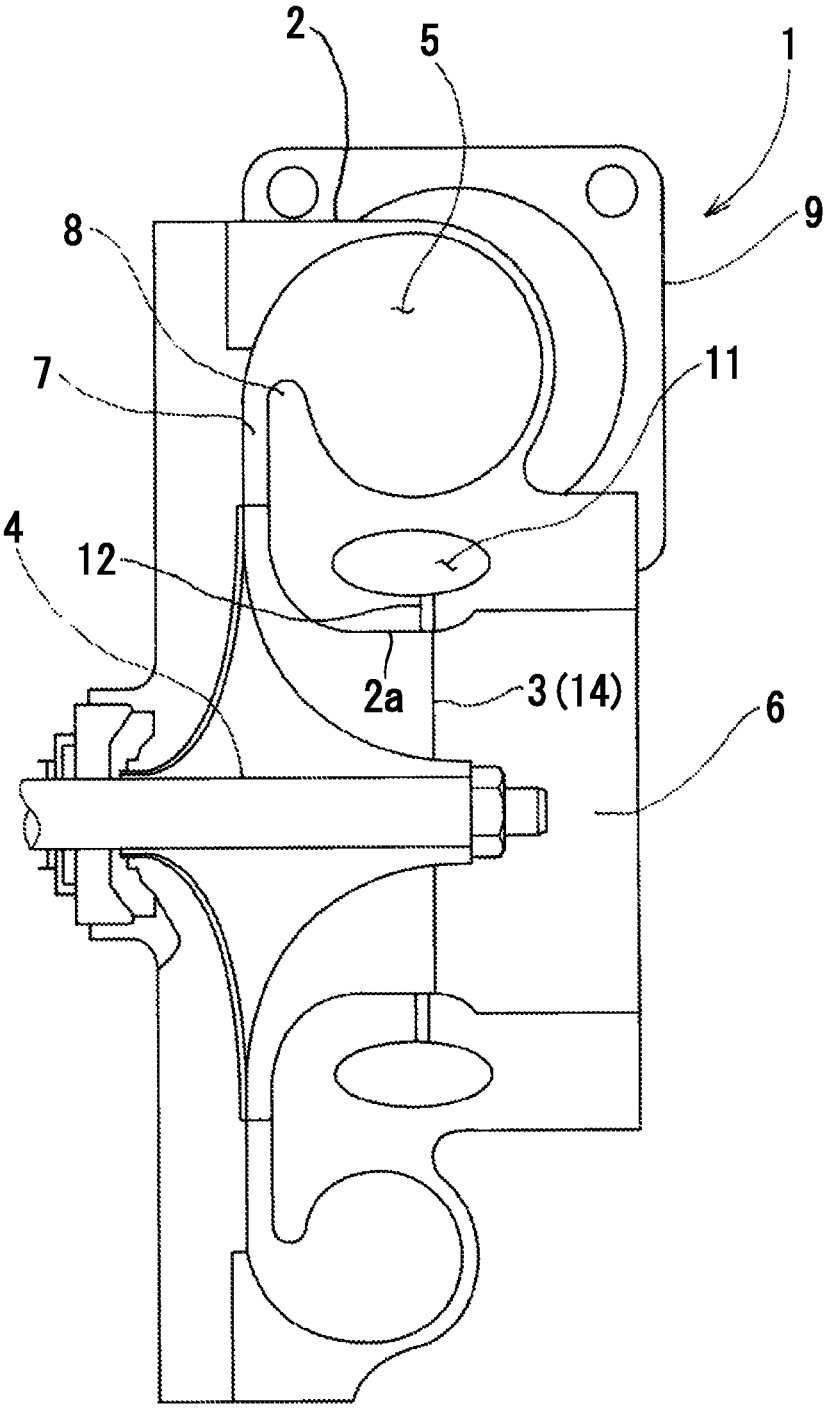
FIG. 1 is a cross-sectional view of a centrifugal compressor according to an embodiment of the present invention.

In FIG. 1, reference signs 1, 2 and 3 represent a centrifugal compressor, a casing and an impeller which is accommodated in the casing, respectively. That is, a centrifugal compressor 1 includes an impeller 3, and a casing 2 accommodating the impeller 3.

The impeller 3 is fixed to one end portion of a rotary shaft 4 which is rotatably supported by a bearing housing (not shown). A turbine (not shown) which generates driving force used to rotate the impeller 3 is connected to the other end portion of the rotary shaft 4. Moreover, the component used to rotate the impeller 3 is not limited to a turbine, and may be a motor or the like.

An annular flow passageway 5 is formed in the casing 2 around the impeller 3, and an outlet 9 is communicated with a certain position of the annular flow passageway 5, wherein the outlet 9 discharges a compressible fluid whose pressure has been increased (e.g., compressed air). An inlet 6 is formed in the center of the casing 2 so as to face the impeller 3 and to be arranged coaxially with the impeller 3.

That is, the casing 2 includes the inlet 6 through which a compressible fluid is suctioned, an impeller-accommodating portion 14 which communicates with the inlet 6 and in which the impeller 3 is disposed, the annular flow passageway 5 formed around the impeller 3, and the outlet 9 communicating with the annular flow passageway 5. Moreover, a fluid flows from the inlet 6 to the impeller-accommodating portion 14 approximately in the axis direction of the rotary shaft 4, and accordingly, the right in FIG. 1 may be referred to as "upstream in the axis direction", and the left in FIG. 1 may be referred to as "downstream in the axis direction".

In the casing 2, a diffuser 7 is formed around the impeller 3 and communicates with the annular flow passageway 5.

The diffuser 7 has a ring-shaped space which communicates the impeller-accommodating portion 14 and the annular flow passageway 5 with each other, wherein the impeller-accommodating portion 14 has a space accommodating the impeller 3 in the casing 2. A partition wall 8 is formed between the annular flow passageway 5 and the diffuser 7.

The turbine is rotated by exhaust gas from an engine (not shown), and the impeller 3 is rotated by rotational driving force transmitted through the rotary shaft 4. The impeller 3 provided coaxially with the turbine is rotated, and air (a compressible fluid, air for combustion of the engine) is suctioned through the inlet 6. The suctioned air is sent outward in the radial direction due to rotation of the impeller 3 and is compressed by passing through the diffuser 7, and thereafter, flows into the annular flow passageway 5. The compressed air is discharged from the annular flow passageway 5 through the outlet 9 to the outside of the centrifugal compressor 1. The discharged air is supplied to the engine.

Next, the casing treatment of this embodiment is described.

In the casing 2, a cylindrical chamber 11 (an annular chamber) disposed coaxially with the inlet 6 is formed. That is, the casing 2 includes the cylindrical chamber 11 which is formed around at least one of the inlet 6 and the impeller-accommodating portion 14. The cylindrical chamber 11 of this embodiment is disposed near the impeller-accommodating portion 14 in the axis direction. The cylindrical chamber 11 has a space which is continuous without being divided in the circumferential direction. Moreover, the cross-sectional shape of the cylindrical chamber 11 (the cross-sectional shape along a plane including the central axis of the rotary shaft 4) is formed in an elliptical shape, but may be in a circular shape, an oval shape, a rectangular shape or the like. The cylindrical chamber 11 is an annular chamber having a predetermined volume V.

A groove 12 is formed on an inner circumferential surface 2*a* of the casing 2 facing the impeller-accommodating portion 14. Moreover, the inner circumferential surface 2*a* is an annular circumferential surface formed coaxially with the impeller 3. The outer end in the radial direction of the groove 12 communicates with the cylindrical chamber 11, and the inner end in the radial direction of the groove 12 opens at the inner circumferential surface 2*a* in the vicinity of the upstream end of the impeller 3. The groove 12 may be a ring-shaped groove formed continuously in the circumferential direction, and may be a groove formed continuously in the circumferential direction, wherein ribs (reinforcement members) are provided at certain intervals inside the groove. In addition, the groove 12 may be an opening portion in which long holes are disposed at certain intervals, wherein the long hole extends in the circumferential direction, and may be an opening portion in which circular holes or rectangular holes are disposed at certain intervals.

The groove 12 communicates the impeller-accommodating portion 14 and the cylindrical chamber 11 with each other, and while the flow rate of a fluid is low, a high pressure occurring in part of the inside of the impeller-accommodating portion 14 is transmitted into the cylindrical chamber 11 through the groove 12. The cylindrical chamber 11 disperses a pressure, and thus, the local increase of a pressure is prevented. The volume V of the cylindrical chamber 11 is configured to be a sufficient volume to disperse a high pressure when the high pressure is transmitted thereinto through the groove 12.

In addition, the groove 12 is formed over the entire circumference of the inner circumferential surface 2*a*. The cylindrical chamber 11 communicates with another space (that is, the impeller-accommodating portion 14 in this embodiment) only through the groove 12.

The shape of the annular flow passageway 5 in the casing 2 is non-axial symmetry. In other words, the cross-sectional shape of the annular flow passageway 5 along a plane including the central axis of the rotary shaft 4 is changed at each position in the circumferential direction of the impeller 3. Accordingly, the pressure inside the annular flow passageway 5 is not uniform at each position in the circumferential direction, and the annular flow passageway 5 has a pressure distribution different at each position in the circumferential direction. Furthermore, the circumferential edge of the impeller 3 also has a pressure distribution different at each position in the circumferential direction, and the pressure distribution of the annular flow passageway 5 is propagated through the diffuser 7 to the impeller-accommodating portion 14 in which the impeller 3 is disposed. That is, the inside of the impeller-accommodating portion 14 also has a pressure distribution different at each position in the circumferential direction, and thus, it is conceivable that a high-pressure part occurs in part of the inside of the impeller-accommodating portion 14, and that the occurrence position thereof is shifted in the axis direction depending on the pressure distribution of the annular flow passageway 5.

The position of the groove 12 is set so that the groove 12 passes by a high-pressure part, based on the pressure distribution of the impeller-accommodating portion 14 or the like. In other words, the position of the groove 12 is set so that the groove 12 faces an occurring high-pressure part. The shape of the groove 12 may be a straight line which passes by a high-pressure part when the inner circumferential surface 2*a* is unfolded so as to be a plane. However, it is preferable that the shape of the groove 12 be a curved line (a shifted curve) which cyclically changes so that the entire circumference (360°) of the inner circumferential surface 2*a* is one cycle and which has a predetermined amplitude in the central axis direction of the inlet 6. The curved line is a sine curve in this embodiment, but may be a curve other than a sine curve.

The shifted curve of the groove 12 is set based on the amount of the shift of a high-pressure part (the amount of the shift in the axis direction) occurring in part of the inside of the impeller-accommodating portion 14, and thus, it is possible to more efficiently communicate the cylindrical chamber 11 and a high-pressure part occurring in part of the inside of the impeller-accommodating portion 14 with each other.

Furthermore, the groove 12 is described in detail.

Figure 2:
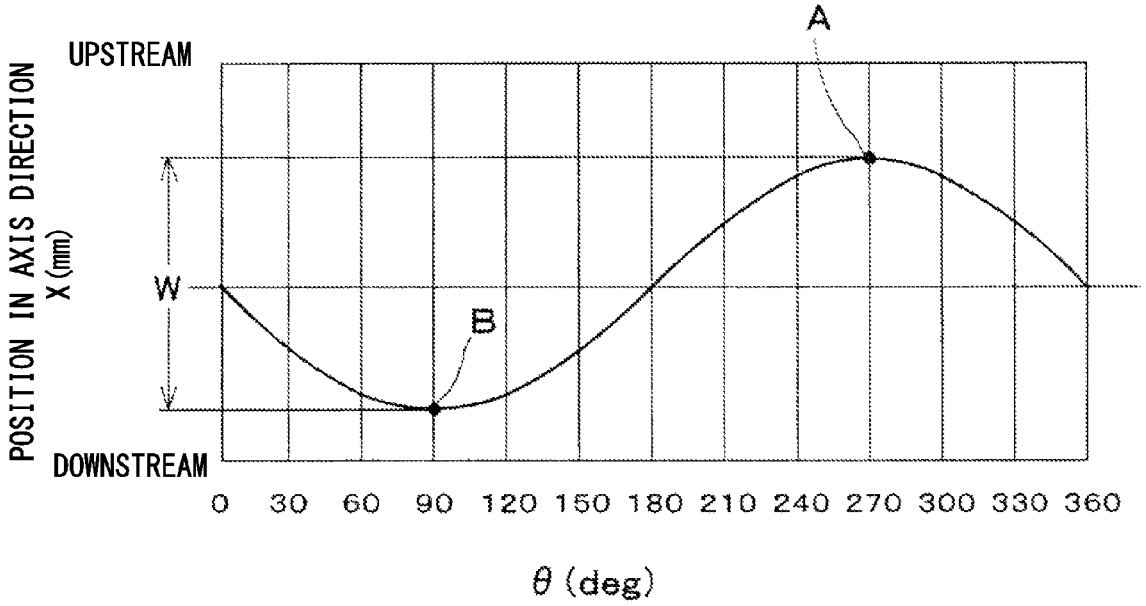
FIG. 2 is a graph showing the shape of a groove used for casing treatment of this embodiment.

FIG. 2 is a development view of the groove 12 and is a graph showing the shape of the groove 12 used for the casing treatment of this embodiment. In the following description, the shifted curve of the groove 12 is described as a sine curve. In FIG. 2, the upper side thereof is shown as upstream (upstream in the axis direction), and the lower side thereof is shown as downstream (downstream in the axis direction). The curved line (a sine curve) shown in FIG. 2 represents the center position of the width at each position of the groove 12 in the central axis direction of the impeller 3. In this embodiment, the maximum diameter ϕD of the impeller 3 is 144.2 mm, and the groove width d of the groove 12 is 3 mm (d/D=0.02). In FIG. 2, a point A represents the most upstream point of the groove 12 (the point being positioned the most upstream in the axis direction), a point B represents the most downstream point of the groove 12 (the point being positioned the most downstream in the axis direction), and W/2 represents a peak amplitude.

Figure 3:
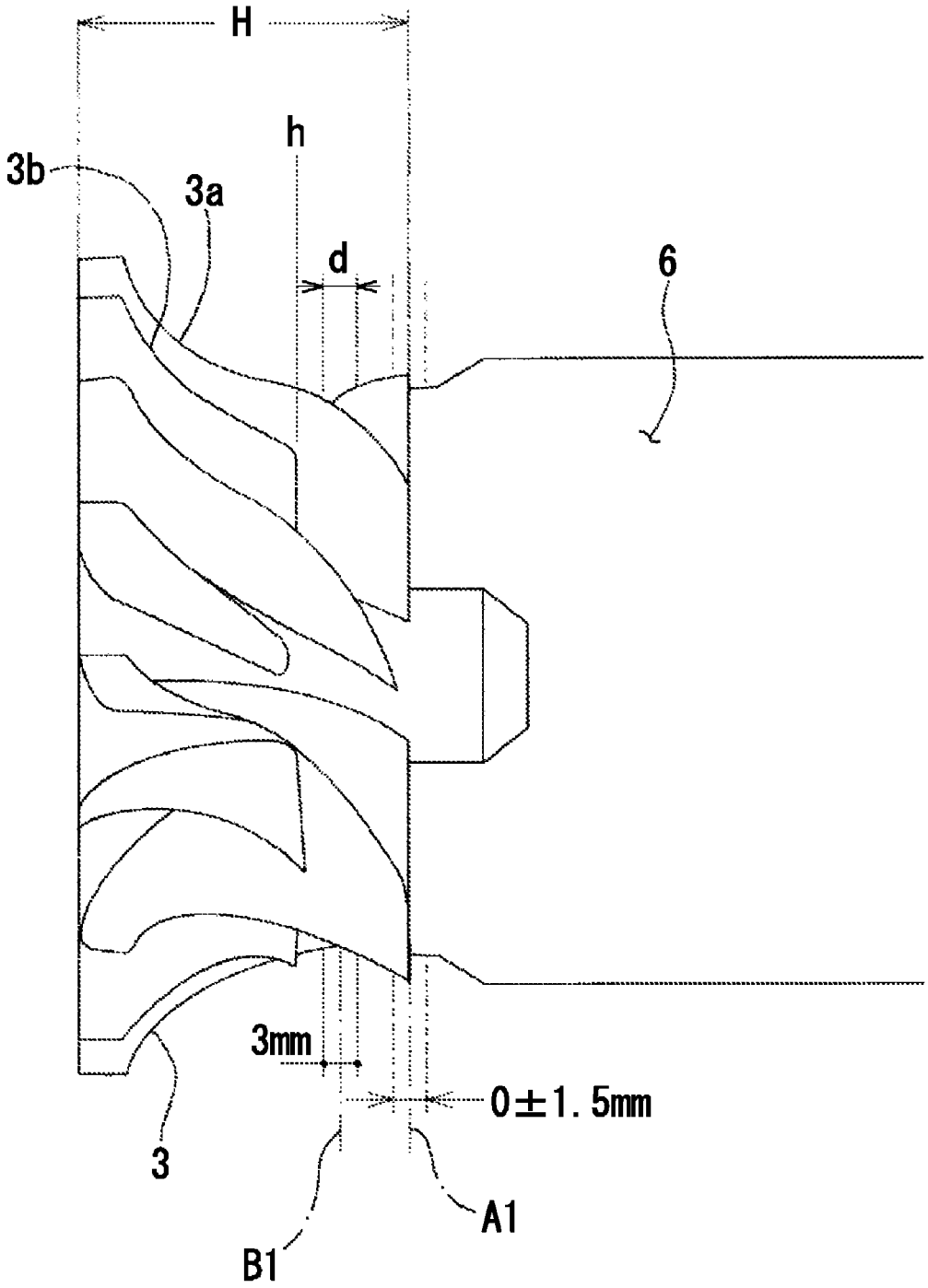
FIG. 3 is a schematic diagram showing the positional relationship between the groove and an impeller according to this embodiment.

FIG. 3 is a schematic diagram showing the positional relationship between the impeller 3 and the groove 12 in the axis direction. In FIG. 3, the groove width of the groove 12 is 3 mm.

In FIG. 3, a line A1 represents the position in the axis direction of the most upstream point A of the grove 12, and a line B1 represents the position in the axis direction of the most downstream point B of the groove 12. That is, in FIG. 3, the groove 12 cyclically changes between the line A1 and the line B1 so that the entire circumference of the inner circumferential surface 2*a* is one cycle.

The line A1 is positioned in the range of ±d/2 (since d is 3 mm, d/2 is 1.5 mm) upstream and downstream with respect to the upstream end of impeller vanes 3*a* (a vane) of the impeller 3. That is, since the line A1 (the most upstream point A) is provided in the range of ±d/2 with respect to the upstream end of the impeller vane 3*a*, the groove 12 (having the groove width d) at the most upstream point A can certainly face the upstream end of the impeller vane 3*a*. The optimal position of the line A1 in the range of ±d/2 is set through calculation, experiments or the like because the optimal position is changed depending on the shape of the casing 2, the characteristics of the impeller 3, or the like.

In a case where the impeller 3 includes small vanes 3*b* as shown in FIG. 3, the lower limit downstream of the position of the line B1 is set to the upstream end (h) in the axis direction of the small vane 3*b*. In contrast, in a case where the impeller 3 does not include small vanes 3*b*, the lower limit downstream of the position of the line B1 is set to approximately the intermediate position in the axis direction of the height H of the impeller vane 3*a*. Moreover, the lower limit position downstream of the most downstream point B (the line B1) of the groove 12 is set to the upstream end of the small vane 3*b* or to the intermediate position in the axis direction of the impeller vane 3*a*. In addition, it is not preferable that the most downstream point B be disposed further downstream, because the surging-suppressing effect is not improved, on the other hand, the compression efficiency deteriorates, and thus, there is no practical meaning.

Figure 4:
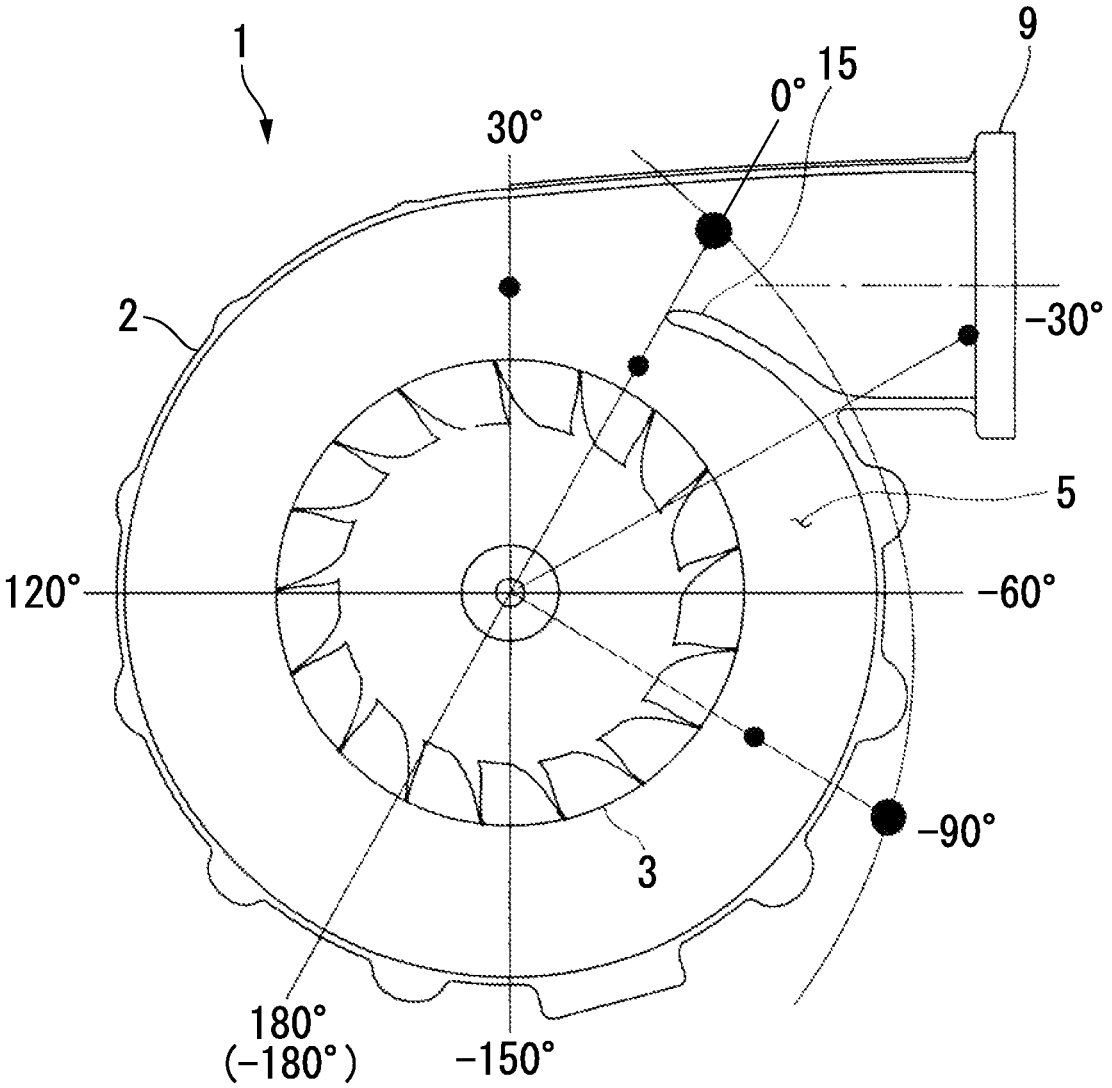
FIG. 4 is a schematic diagram showing the positional relationship between a casing and the most downstream point of the groove according to this embodiment.

The position in the circumferential direction of the most downstream point B of the groove 12 is described with reference to FIG. 4. FIG. 4 is a schematic diagram showing the positional relationship between the casing 2 and the most downstream point B of the groove 12 according to this embodiment, and is a diagram viewed in the central axis direction of the impeller 3.

In FIG. 4, the position of the most downstream point B of the groove 12 is shown using the rotation center of the impeller 3 as a reference. Moreover, since a fluid inside the annular flow passageway 5 of FIG. 4 flows in the clockwise direction in FIG. 4 due to rotation of the impeller 3, a position shifted in the clockwise direction from a certain position may be referred to as "downstream in the circumferential direction", and a position shifted in the counter-clockwise direction from a certain position may be referred to as "upstream in the circumferential direction".

In FIG. 4, a reference sign 15 represents a tongue portion which is formed between the outlet 9 and the annular flow passageway 5. In the following description, the position of the tongue portion 15 is shown as 0°, and the opposite position to the tongue portion 15 across the rotation center of the impeller 3 is shown as 180° (or −180°). An angle upstream in the circumferential direction from the tongue portion 15 is represented by a positive value, and an angle downstream in the circumferential direction from the tongue portion 15 is represented by a negative value. In addition, more precisely, the position of the upstream end in the circumferential direction of the tongue portion 15 is shown as 0°.

When the most downstream point B of the groove 12 is positioned in the range from the position which is at 120° upstream (in the counter-clockwise direction) from the tongue portion 15, to the position which is at 180° downstream (in the clockwise direction) from the above position of 120° (in FIG. 4, the range from the position of 120° to the position of −60° corresponding to the upper half of the impeller 3 from the rotation center thereof), the surging-suppressing effect is obtained. Moreover, according to the result of experiments, when the most downstream point B is disposed at the position of the tongue portion 15 (0°), the highest surging-suppressing effect was obtained. However, the most downstream point B is determined based on the pressure distribution or the like of the circumferential edge of the impeller 3, and the pressure distribution is changed depending on the shape, the characteristics or the like of the impeller 3, and therefore, the preferable position of the most downstream point B may not correspond to the position of the tongue portion 15.

However, the optimal position of the most downstream point B exists in the vicinity of the tongue portion 15, for example, in the range between positions of ±45° with respect to the tongue portion 15. Accordingly, it is preferable that the most downstream point B be provided in the range from the position of +120° to the position of −60° (an angle in the opposite direction to the rotation direction of the impeller 3 is represented by a positive value) with respect to a straight line (a reference radial line) connecting the tongue portion 15 and the rotation center of the impeller 3, and furthermore, it is more preferable that the most downstream point B be provided in the range of ±45° with respect to the reference radial line.

Figure 5:
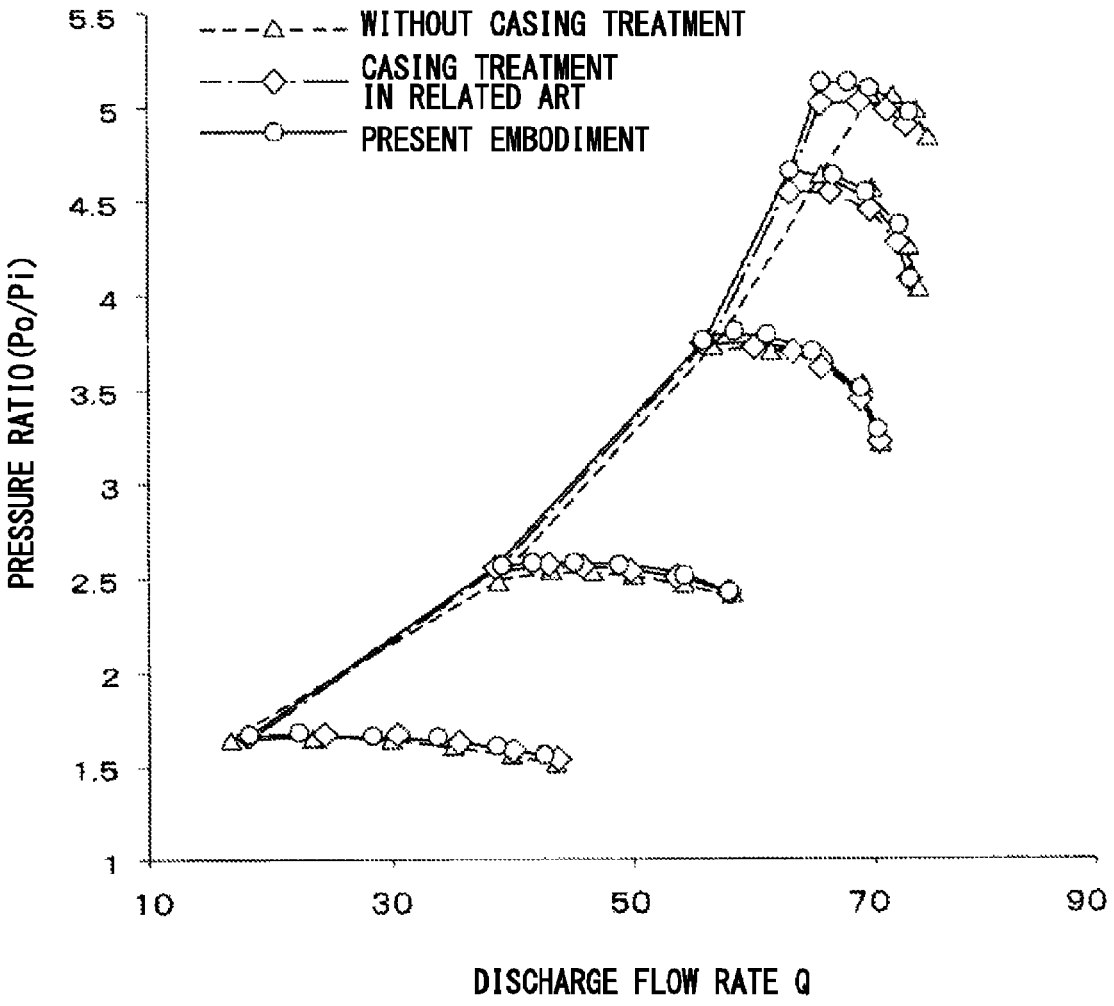
FIG. 5 is a graph showing the relationship between performance of casing treatment and operation characteristics of a centrifugal compressor.

FIG. 5 is a graph showing a relationship between performance of casing treatment and operation characteristics of a centrifugal compressor, the horizontal axis thereof represents a discharge flow rate (Q), and the vertical axis thereof represents a pressure ratio (Po/Pi: Po representing a fluid outflow section pressure, Pi representing a fluid inflow section pressure).

In FIG. 5, three curves are shown at each of five places. In FIG. 5, triangle marks represent operation characteristics of a centrifugal compressor not performing casing treatment. Square marks (diamond marks) represent operation characteristics of a centrifugal compressor performing casing treatment in the related art. In casing treatment in the related art, the wall surface of a casing adjacent to the upstream end of an impeller is provided with a groove formed over the entire circumference of the wall surface, and the groove is communicated with a flow passageway (an inlet) positioned upstream of the impeller. In addition, while the flow rate of a fluid is low, a fluid reversely flows upstream of the impeller through the above groove from a high-pressure part occurring in part of the inside of an impeller-accommodating portion, and part of a fluid is recirculated.

Circle marks represent operation characteristics of a centrifugal compressor performing the casing treatment of this embodiment. That is, the wall surface (the inner circumferential surface 2*a*) of a casing 2 adjacent to the upstream end of an impeller 3 is provided with a groove 12 formed over the entire circumference of the wall surface, the unfolded groove 12 has a sine curve shape (sine curve treatment), and the most downstream point B of the groove 12 is disposed at the same position as the tongue portion 15 in the circumferential direction (refer to FIGS. 2 and 4).

The above curves are formed by connecting the same marks. In addition, these curves indicate that the discharge pressure of a fluid is increased by gradually decreasing the flow rate of the fluid (leftward in FIG. 5), and that the flow rate starts being decreased from each of predetermined five flow rates. Moreover, the leftmost marks of the curves of the same marks are connected by straight lines. Since the leftmost mark of each curve indicates that surging of a compressor occurs therein, the left area of each straight line of FIG. 5 indicates that the surging occurs and the compressor cannot operate therein. That is, each straight line represents a surging limit value of a centrifugal compressor.

In FIG. 5, the straight lines connecting circle marks are positioned more leftward in FIG. 5 than the straight lines connecting triangle marks or square marks. Accordingly, in this embodiment, it is possible to set the discharge flow rate thereof to a smaller flow rate than that of a compressor performing casing treatment in the related art and of a compressor not performing casing treatment. That is, in this embodiment, the surging limit value is shifted to a low-flow rate side, and the high surging-suppressing effect is obtained.

In addition, unlike casing treatment in the related art, in this embodiment, a fluid does not reversely flow upstream of the impeller, and part of a fluid is not recirculated, and therefore, the discharge flow rate is not decreased. Furthermore, since a fluid does not reversely flow upstream of the impeller, the reduction of the discharge pressure is prevented, and the pressure ratio in a low-flow rate can be increased compared to casing treatment in the related art. This is clearly shown in FIG. 5, because the curves connecting circle marks are positioned more upward in FIG. 5 than the curves connecting square marks.

In this embodiment, the position of the most downstream point B of the groove 12 capable of improving the surging-suppressing effect is in the range from +120° to −60° with respect to the position of the tongue portion 15 (an angle in the opposite direction to the rotation direction of the impeller 3 is represented by a positive value), more preferably, in the range of ±45° with respect to the position of the tongue portion 15.

The position of the most downstream point B of the groove 12 is set into the range of ±45° with respect to the position of the tongue portion 15, and thereby, it is possible to improve the surging-suppressing effect without decreasing the pressure ratio, compared to casing treatment in the related art. Moreover, in order to determine a more appropriate position of the most downstream point B in the range of ±45°, it is preferable that the position be determined by calculation in view of the shape of the casing 2, the characteristics of the impeller 3, the capacity of the centrifugal compressor 1, or the like.

Hereinbefore, the preferable embodiment of the present invention was described with reference to the drawings, but the present invention is not limited to the above embodiment. The shape, the combination or the like of each component shown in the above-described embodiment is an example, and additions, omissions, replacements, and other modifications of configurations can be adopted within the scope of and not departing from the gist of the present invention. The present invention is not limited to the above descriptions and is limited only by the scopes of the attached claims.

For example, in the above embodiment, the curved line shown by the groove 12 was described as a sine curve. However, it is sufficient if the curved line cyclically changes so that the entire circumference of the inner circumferential surface 2*a* is one cycle and has a predetermined amplitude in the central axis direction of the inlet 6, and the curved line does not have to be a sine curve.

In addition, the groove 12 communicates the impeller-accommodating portion 14 and the cylindrical chamber 11 with each other, and disperses, into the cylindrical chamber 11, a high pressure locally occurring inside the impeller-accommodating portion 14 while the flow rate of a fluid is low, thereby preventing local increase of a pressure. Accordingly, even if the groove 12 is formed as a straight line, when the position thereof is set so as to pass through the position of the most downstream point B, it is possible to disperse a local high pressure into the cylindrical chamber 11 and to improve the surging-suppressing effect.

The groove 12 of this embodiment is formed on a row in the circumferential direction of the inner circumferential surface 2*a*. In a case where the groove 12 is formed as a straight line, the groove 12 may extend parallel to the circumferential direction of the inner circumferential surface 2*a* over the entire circumference thereof, or may be composed of straight lines. For example, the groove 12 may be formed in a triangle wave shape in which straight lines connect the most upstream point A and the most downstream point B to each other in FIG. 2. In addition, the groove 12 can be formed in a trapezoid wave shape or in a rectangular wave shape.

INDUSTRIAL APPLICABILITY

The present invention can be applied to a centrifugal compressor which increases the pressure of a compressible fluid.

DESCRIPTION OF REFERENCE SIGNS

1 centrifugal compressor
2 casing
2*a* inner circumferential surface
3 impeller
3*a* impeller vane (vane)
4 rotary shall
5 annular flow passageway
6 inlet
9 outlet
11 cylindrical chamber (annular chamber)
12 groove
14 impeller-accommodating portion
15 tongue portion
A most upstream point
B most downstream point

The invention claimed is:

1. A centrifugal compressor comprising:
an impeller; and
a casing accommodating the impeller,
wherein the casing includes:
an inlet;
an impeller-accommodating portion, the impeller being disposed in the impeller-accommodating portion;
an annular flow passageway formed around the impeller;
an outlet communicating with the annular flow passageway; and
an annular chamber formed around at least one of the inlet and the impeller-accommodating portion;
a tongue portion formed between the outlet and the annular flow passageway,
wherein a reference radial line connecting a rotation center of the impeller and a tip of the tongue portion forms an angle of 30° with a line connecting a first point where the outlet and the casing intersect and the rotation center of the impeller, and forms an angle of 30° with a line connecting a second point where the outlet and the casing intersect and the rotation center of the impeller,
wherein an inner circumferential surface of the casing facing the impeller-accommodating portion is provided with a groove which communicates the impeller-accommodating portion and the annular chamber with each other and the groove is formed over an entire circumference of the inner circumferential surface,
wherein a most upstream point of the groove is provided at a position facing an upstream end of the vane of the impeller in the central axis direction,
wherein a most downstream point of the groove is positioned in a range from a position of 120° upstream with respect to the reference radial line to a position of 60° downstream with respect to the reference radial line; and
the annular chamber communicates with another space only through the groove.

2. The centrifugal compressor according to claim 1,
wherein the groove is formed as a curved line which cyclically changes so that the entire circumference of the inner circumferential surface is one cycle and which has a predetermined amplitude in a central axis direction of the inlet.

3. The centrifugal compressor according to claim 2,
wherein the most downstream point of the groove is positioned in a range from a position of 45° upstream with respect to the reference radial line, to a position of 45° downstream with respect to the reference radial line.

* * * * *